US009702155B2

(12) United States Patent
Nunley

(10) Patent No.: US 9,702,155 B2
(45) Date of Patent: Jul. 11, 2017

(54) METHODS OF REPLACING COMPROMISED COMPOSITE-STRENGTH CONCRETE ROOFS

(71) Applicant: Loadmaster Systems Inc., Norcross, GA (US)

(72) Inventor: Charles L Nunley, Norcross, GA (US)

( * ) Notice: Subject to any disclaimer, the term of this patent is extended or adjusted under 35 U.S.C. 154(b) by 0 days.

(21) Appl. No.: 14/970,409

(22) Filed: Dec. 15, 2015

(65) Prior Publication Data

US 2016/0201346 A1 Jul. 14, 2016

Related U.S. Application Data

(60) Provisional application No. 62/092,104, filed on Dec. 15, 2014.

(51) Int. Cl.

| | |
|---|---|
| ***E04B 1/00*** | (2006.01) |
| ***E04G 23/02*** | (2006.01) |
| ***E04B 7/20*** | (2006.01) |
| ***E04D 3/36*** | (2006.01) |
| ***E04D 13/16*** | (2006.01) |

(52) U.S. Cl.

CPC ..... *E04G 23/0281* (2013.01); *E04B 7/20* (2013.01); *E04D 3/3608* (2013.01); *E04D 13/1643* (2013.01); *E04D 13/1681* (2013.01); *E04G 23/0218* (2013.01)

(58) Field of Classification Search

CPC ..... E04G 23/0281; E04B 7/20; E04D 3/36; E04D 3/26

USPC ..... 52/745.06, 741.41, 746.11, 746.1; 14/73

See application file for complete search history.

(56) References Cited

U.S. PATENT DOCUMENTS 4,736,561 A * 4/1988 Lehr ..... E04D 11/02 52/199
4,991,248 A * 2/1991 Allen ..... E01D 19/125 14/73
6,312,541 B1 * 11/2001 Hemphill ..... E01C 7/147 156/293

* cited by examiner

*Primary Examiner* — Basil Katcheves
*Assistant Examiner* — Joshua Ihezie
(74) *Attorney, Agent, or Firm* — Peter V. Schroeder; Booth Albanesi Schroeder PLLC

(57) ABSTRACT

Retrofitting a horizontal building roof having a pre-existing, composite-strength concrete roof having a corrugated steel deck with concrete poured over the deck top. Replacing the pre-existing roof with a dry-installed composite-strength roof having a rigid sheet installed over a corrugated steel deck, the rigid sheet attached to the deck by mechanical fasteners extending through the rigid sheet and the upper ribs of the corrugated deck. The newly installed roof restrains the upper ribs against lateral distortion under loading, thus forcing the corrugated deck to maintain shape and operate to composite capacities in excess of predictable flexural load capabilities of its components considered alone.

16 Claims, 5 Drawing Sheets

*FIG.* 4

METHODS OF REPLACING COMPROMISED COMPOSITE-STRENGTH CONCRETE ROOFS

BACKGROUND

As buildings age across the United States, a great number of horizontal roof deck assemblies having poured concrete over a corrugated steel deck are in need of repair or replacement. In fact, under current building codes, namely as set forth in the International Building Code, many older flat roofs may be dangerous or classified as in a state of possible collapse. Many of these flat roofs are "composite roofs" or "composite strength roofs" which rely on the combined strength characteristics of their components, as installed, to meet load requirements and where the components considered individually are insufficient to meet those requirements. These roofs have aged and been damaged resulting in the bonding between the concrete and deck to fail. In other words, the concrete "pops off" the deck, cracking sometimes into numerous pieces of concrete rubble. Consequently, these roofs are in need of repair and methods are needed to economically effect these repairs.

BRIEF DESCRIPTION OF THE DRAWING

A drawing of exemplary embodiments of the disclosure are annexed hereto so that the disclosure may be better and more fully understood, in which.

DESCRIPTION OF PREFERRED EMBODIMENTS

Figure 1:
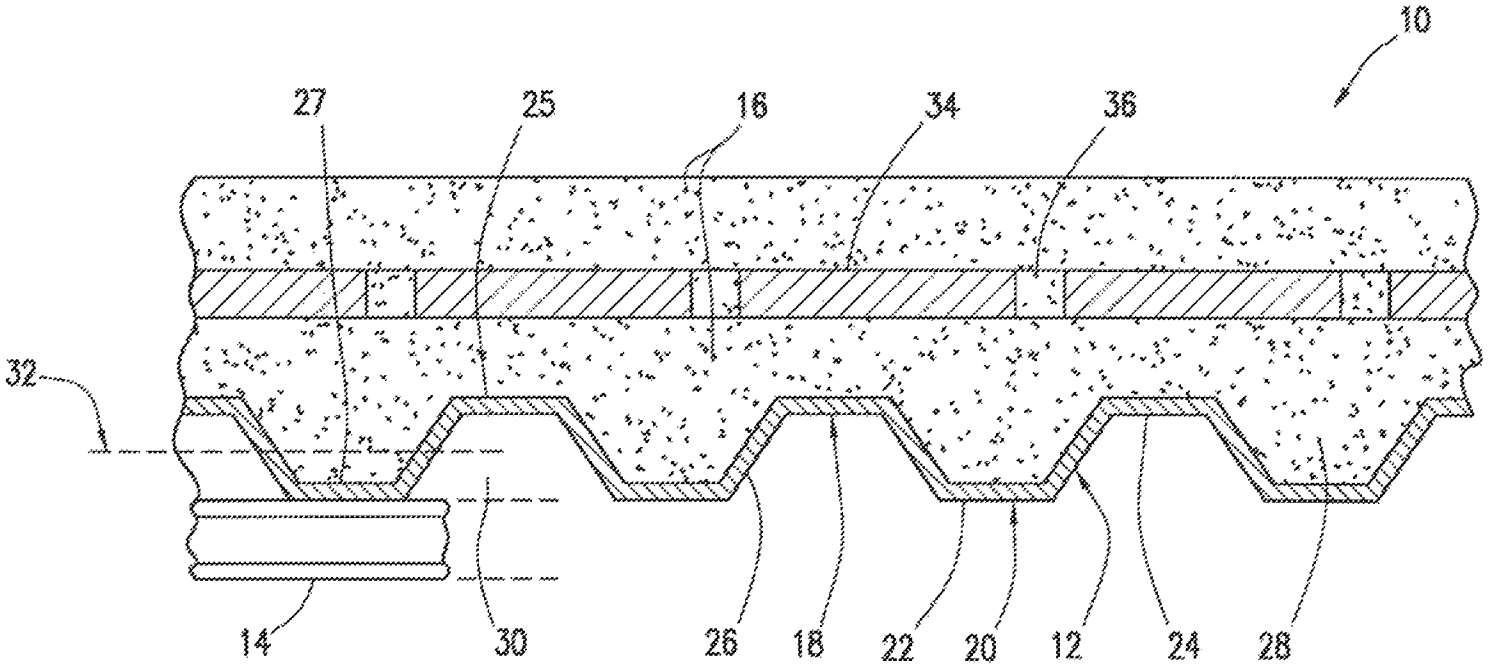
FIG. 1 (PRIOR ART)
FIG. 1 is an illustration of an exemplary prior art horizontal, composite-strength roof deck assembly, generally designated, having a symmetrically corrugated steel deck secured to horizontal supports and overlaid with roofing concrete.

As explained above, repair or replacement is increasingly needed for horizontal composite strength roofs having poured concrete bonded to a corrugated steel deck below. The composite strength roofs employ a corrugated steel deck, supported by and attached to horizontal supports below, covered with roofing concrete. The roofing concrete is sometimes called, and herein includes, lightweight roofing concrete, lightweight insulating concrete, non-structural concrete, foam concrete, and the like. The composite strength of these roofs depends on sufficient bonding between the concrete and the corrugated deck such that the combined components, considered together as-installed, meet load requirements, such as gravitational load, wind uplift resistance, and diaphragm shear load. The concrete is bonded to the steel deck, typically by chemical reaction, and effectively stiffens the steel deck sections. Depth requirements for the concrete varied but were typically about two inches minimum above the upper rib portions of the corrugated deck.

Steel roof deck referenced herein is a corrugated, steel, roof deck, formed in generally flat sheets or panels and having parallel stiffening ribs extending across the sheet. The flat surfaces of the upper ribs provide a supporting surface for one or more layers of rigid sheet material. The corrugations define upper and lower ribs and, in a symmetrical deck, have an equal distribution of steel above and below a neutral axis lying in a plane passing through the center of the sheet and disposed parallel with upper and lower surfaces of the sheet. Symmetrically corrugated deck has been historically used for composite and non-composite cement roof assemblies, however non-symmetric deck is also known in the art.

More recently, symmetrically corrugated configuration has been used in flat roof, dry-installed, composite strength roof deck construction. For further disclosure to such, see U.S. Pat. Nos. 4,736,561, to Lehr, et al., and 5,584,153, to Nunley, et al., which are incorporated herein by reference for all purposes. Dry-installed composite strength roofing relies on the composite strength of the connected components of the roof deck assembly rather than the strength characteristics of the components individually. The roof components identified in the Lehr patent are a corrugated steel roof deck, attached to a rigid, high-density sheet above, by a plurality of fasteners (preferably threaded), and wherein these components are fastened together to create horizontal and vertical trusses.

As used herein, dry-installed composite strength roof assemblies (and similar) are those which rely on their composite strength characteristics, as installed, to meet load and resistance requirements. That is, the corrugated steel deck, rigid sheet, and fasteners, considered in composite together, as installed, provide sufficient strength characteristics, whereas the deck alone or rigid sheet alone fail to provide sufficient strength. As used herein, composite strength concrete roof assemblies (and similar) are those which rely on their composite strength characteristics, as installed, to meet load and resistance requirements. That is, the corrugated steel deck, and the overlaid and dried concrete, considered in composite, as installed, provides sufficient strength characteristics, whereas the deck or concrete alone fail to provide sufficient strength.

FIG. 1 is an illustration of an exemplary prior art horizontal, composite-strength roof deck assembly, generally designated 10, having a symmetrically corrugated steel deck 12 secured to horizontal supports 14 and overlaid with roofing concrete 16.

As explained above, the composite strength roof assembly is defined by the strength of the installed roof assembly; that is, the composite strength of the roof is the strength of the roofing components acting together to meet load requirements. The steel deck alone is not sufficient to meet load-bearing requirements. Similarly, the concrete alone fails to provide adequate strength. The concrete, once in place, dried, and bonded to the deck, stiffens the steel section and prevents the corrugations from "folding over" under shear load. Such roof assemblies have been widely used and many are now aged, damaged, or otherwise unfit for use and need repair or replacement. Horizontal supports as used herein includes various types of horizontal roof deck supports, such as purlins, rafters, beams, joists, etc.

Composite concrete roofs are horizontal, typically between zero and three degrees from horizontal or have a slope ranging from about 0.25/12 to 2/12. Low slope allows the poured concrete to set, or dry, without creating substantial uneven areas.

The steel roof deck 12 has symmetrical corrugations creating upper ribs 18 and lower ribs 20 or ridges extending longitudinally across the deck. Corrugated deck 12 has flat, substantially horizontal, upper and lower rib portions 22 and 24, respectively, typically of substantially equal width, and pitched connector portions 26 extending therebetween. The symmetrical corrugation provides straight, parallel, regular, and equally dimensioned upper and lower ribs. Similarly, the deck defines symmetrical upper and lower hollows 28 and 30, respectively. This deck configuration has a substantially equal distribution of surface area and weight of the corrugated deck above and below the neutral axis 32. The dimensions of the corrugated deck vary depending on anticipated loads, span, etc. Typical steel decks are made of 28 to 20 gauge steel, sometimes higher. The most common deck shape is symmetrical, as explained above, however other shapes are known in the art.

In some prior art concrete roof assemblies, insulation board 34 was positioned between upper and lower layers of concrete 16. Often referred to as "holey board," such insulation boards have perforations 36 such that the concrete fills the holes, creating columns extending between upper and lower concrete layers.

A further feature of prior art composite concrete roofs is ventilation systems to assist in drying the wet-poured concrete. Ventilation systems employed in prior art composite concrete roofs include vented corrugations (e.g., having holes in the rib portions), vent passageways defined in the steel deck (e.g., lateral indentations extending across the deck ribs), and vent "clips" positioned between adjacent deck panels. It is not unusual to find concrete which has penetrated between adjacent deck panels during setting.

As composite concrete roofs age and experience significant loads and resulting deflections, it is common for the concrete to crack, break into pieces, or "pop loose" of the steel deck thereby breaking the concrete-to-steel bonding necessary to achieve composite strength. For example, significant roof deflection can be induced by severe or repetitive wind uplift or diaphragm shear loading. Concrete can also crack due to weather effects and common loading. Repairing or replacing aged or damaged composite concrete roofs is an expensive proposition. Repairing the roof typically includes removing the concrete and re-laying new concrete. If the roof deck is compromised, it must be removed and replaced as well.

The disclosed methods herein provide an alternative replacement process wherein a composite-strength concrete roof assembly is replaced with a composite-strength dry-installed roof assembly. Such dry-installed assemblies are typically less expensive and easier to perform.

Figure 2:
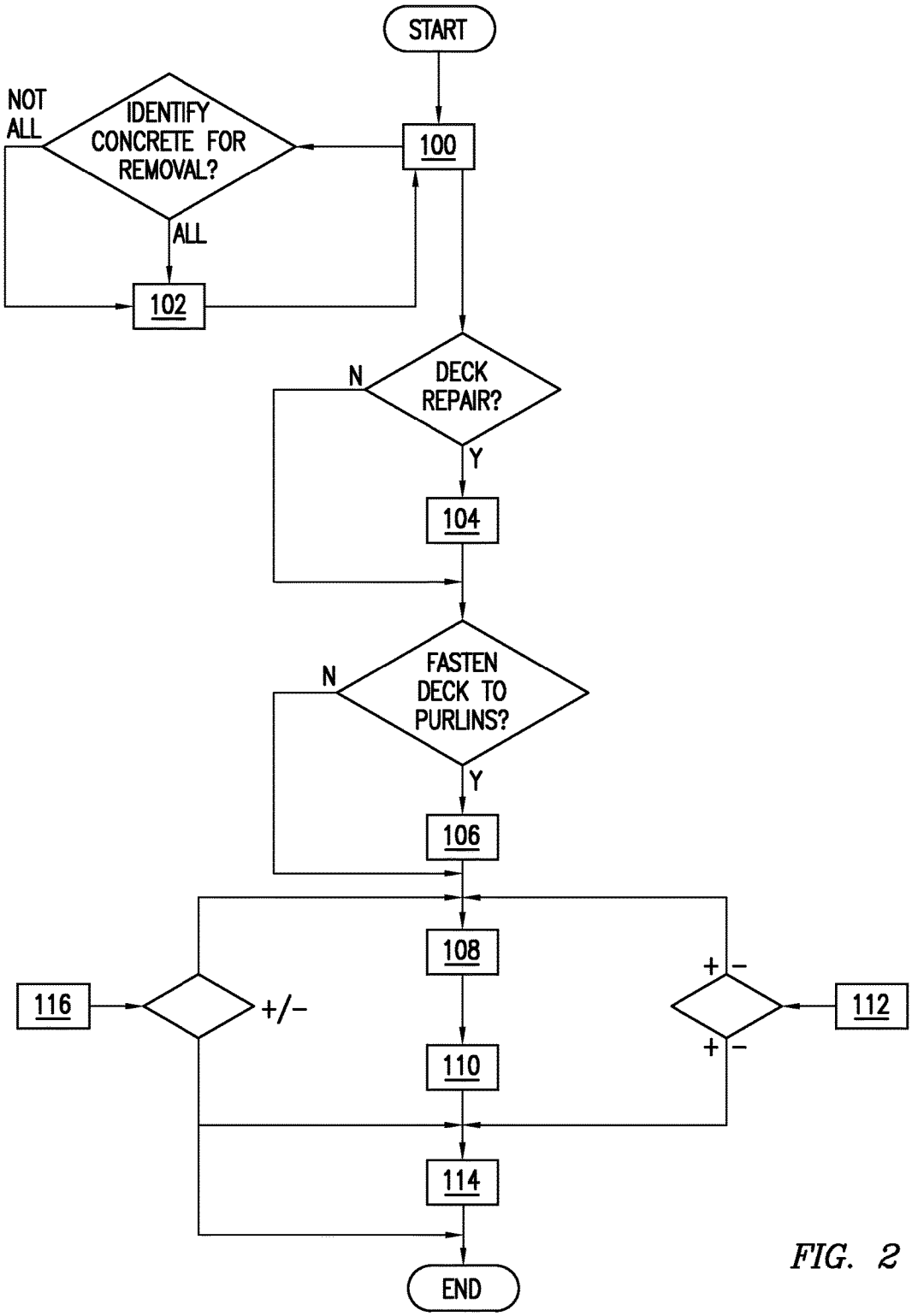
FIG. 2 is an exemplary flow chart of an exemplary composite roof replacement method according to an aspect of the disclosure.

FIG. 2 is an exemplary flow chart of an exemplary composite roof replacement method according to an aspect of the disclosure. In the method, the existing composite-strength concrete roof assembly is evaluated 100, such as for concrete and deck damage, state of disrepair, type of concrete, gauge and configuration of steel deck, attachment of deck to horizontal supports, concrete-to-deck bonding, etc.

If it is determined that the existing roof is a viable candidate for the disclosed replacement method, then some or all of the existing roof assembly components, or portions thereof, are removed from the building. Removal can include the following, in no particular order: removing some or all of one or more concrete layers; breaking up, scraping off, prying off, or otherwise removing the concrete; removing some or all of the steel deck or panels thereof; removing holey board or insulation materials; removing pipes encased in the concrete; removing ventilation systems such as vent "clips;" and/or removing concrete from seams at adjacent deck panels. Breaking up, scraping off, or otherwise removing the concrete can be performed manually, such as by repeatedly striking the deck with a hammer, sledge-hammer, crowbar, or other blunt object. Alternately, such actions can be performed using suitable machinery, such as jack-hammers, breakers, demolition hammers, rotary hammers, mechanical scrapers, mechanical strippers, and small loading or dozing machinery.

Removal of the concrete at step 102, according to exemplary and alternative method, can comprise various steps or actions, singly or in combination. For example, removal of the concrete can comprise removing concrete to expose the upper surfaces 25 of the upper rib portions 24. Such removal allows for positioning of rigid sheets across the upper ribs. Further, concrete removal can include removing some or all of the concrete positioned in the lower hollows 28. Concrete removal in some embodiments includes removing concrete to expose only portions of the upper surfaces 27 of the lower rib portions 22. For example, removal of concrete to expose only some areas of the upper surfaces 27 of the lower rib portions can be performed to allow selective attachment of the steel deck 12 and horizontal supports 14. Stated another way, removal of concrete can include intentionally leaving some concrete in place, namely, in the lower hollows 28 or on the upper surfaces 27 of the lower rib portions 22. This can be time and labor saving, especially since the concrete may tend to crack through or break off at the top of the deck corrugations. Note that in some methods it is not necessary to remove ventilation systems, vent clips, encased pipes, etc., if such does not interfere with the replacement of concrete with dry-installed composite components.

Where the steel roof deck is also damaged, the method can optionally include repair or replacement of the deck, deck panels, or portions thereof, at 104. Repair of the deck or panels can be performed by, for example, sanding, blasting, patching, welding, or coating all or part of a deck or panel. Where necessary, the replacement method can include removal and replacement of one or more deck panels or the entire deck.

Once the roof is prepared by removal of concrete, the method includes installation of dry-installed roofing components to form a composite-strength, steel deck and dry board deck assembly.

Figure 3:
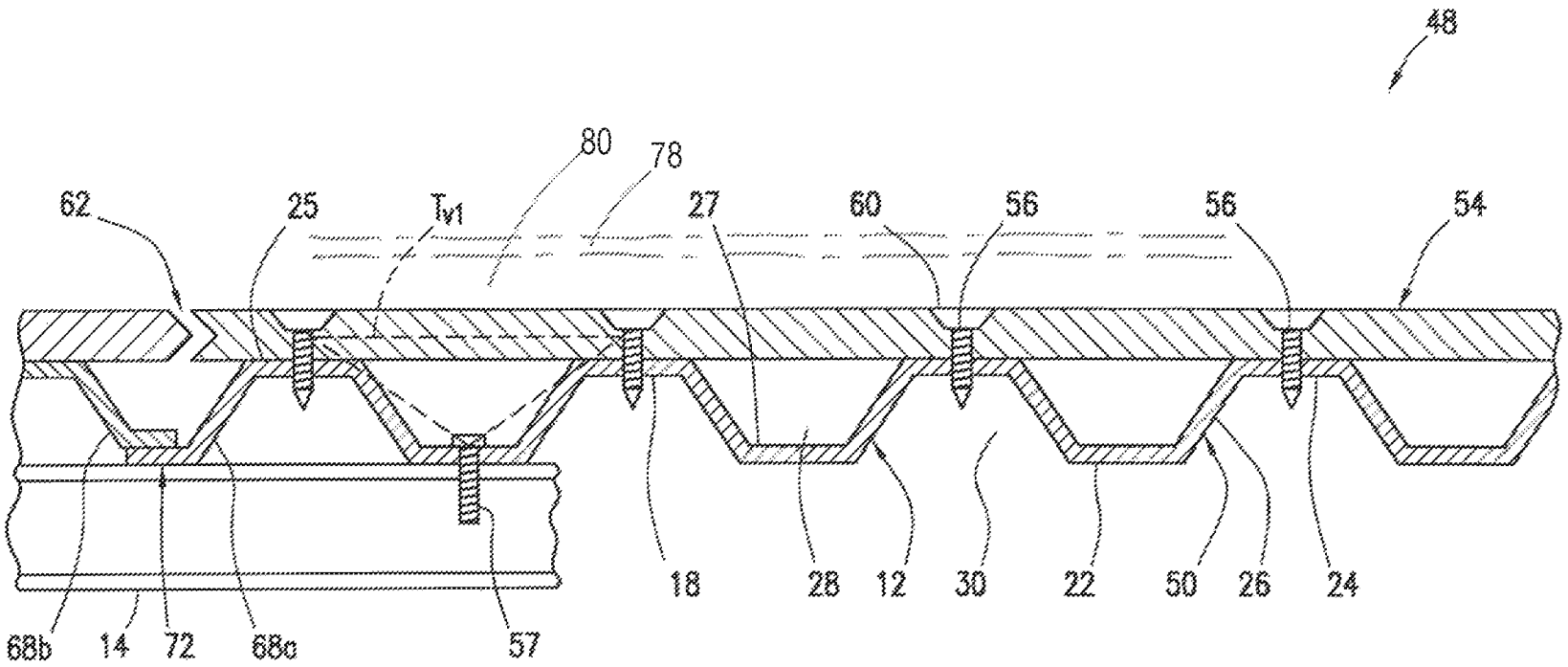
FIG. 3 is an illustration of an exemplary dry-installed, composite strength roof deck assembly, installed according to aspects of the disclosure.

FIG. 3 is an illustration of an exemplary dry-installed, composite strength roof deck assembly, installed according to aspects of the disclosure.

The dry-installed composite roof deck assembly 48 includes a corrugated steel deck 50 attached to, and supported from below by, horizontal supports 14. The deck is attached to the support by connectors 57, which can be welds, fasteners, threaded screws, etc. Opposing edges of the corrugated deck, or panels thereof, are supported by generally parallel, horizontal supports, such that the deck creates a span between supports. A flat, rigid sheet 54 is secured from above by mechanical fasteners 56 to the corrugated deck. The aged or damaged composite concrete roof assembly is replaced with such a dry-installed composite roof assembly according to the disclosure. In some instances, it may be possible to use components, such as the steel deck, from the pre-existing composite concrete roof assembly in the replacement dry-installed composite roof assembly.

Depending on the construction procedures and materials used during initial installation of the composite concrete roof assembly, the corrugated deck may be attached to the horizontal supports by pre-existing connections such as a series of welds, screws, or other fasteners. The disclosed method in some embodiments includes identifying such pre-existing connections (including their number, pattern, state of repair, etc.), evaluating their sufficiency for use with the to-be-installed roof assembly, calculating the load bearing capacity of the pre-existing connections, etc., before step 106 of FIG. 2.

According to an aspect of the disclosure, at 106 of FIG. 2, fasteners 57 are applied to secure the corrugated deck 50 to the horizontal supports 14 in sufficient number and appropriate locations to meet load and code requirements.

In most instances, the pre-existing connections are a series of welds performed at or near the perimeters of the corrugated deck, or deck panels, attaching the deck to the horizontal deck supports. Additional welds may be located attaching the deck to intermediate horizontal supports, where present. Where welds are present and functional, they typically do not meet current load or code requirements. Consequently, according to an aspect of the disclosed methods, the corrugated deck is secured to the horizontal supports using a plurality of fasteners 57, preferably threaded fasteners.

It may be possible to calculate the load bearing capacity of existing connections, calculate a required number and location of fasteners to supplement the pre-existing connections such that the combination of fasteners, pre-existing deck-to-support connections, and other dry-installed roof components, in composite, meet load requirements. It is unlikely that pre-existing welds are sufficient to meet load requirements, but if so, they are left in place. These methods are indicated, if applicable, at the decision node before step 106 of FIG. 2.

A typical composite concrete roof assembly uses multiple corrugated steel deck panels 68*a-b* positioned adjacent one another, defining panel seams 72, to create the roof deck 50 as a whole. FIG. 3 is a cross-sectional view of two corrugated deck panels 68*a-b* positioned adjacent one another according to an aspect of the disclosure. Adjacent deck panels 68*a-b* from the pre-existing composite concrete roof assembly typically have overlapping lower rib portions along the seams of adjacent deck panels. The adjacent panels, however, tend to not be mechanically fastened together by welds, threaded fasteners, and the like, in composite concrete roofs. Further, the concrete tends to flow into and between the seams 70 defined between adjacent panels 68*a-b* prior to hardening. Consequently, in some methods of the disclosure it is necessary to remove concrete from the panel seams 70, at 106. Further, at 106, the method includes connecting adjacent deck panels 68*a-b* together proximate seams 72 to limit or eliminate relative movement between the panels 68*a-b* , thereby creating a functionally monolithic roof deck. Preferably, the adjacent panels are fastened together using threaded fasteners. Welds may be acceptable in some circumstances.

The disclosed methods include, at 108, positioning a rigid sheet 54, or one or more panels thereof, horizontally above the corrugated deck 50 and spanning adjacent upper ribs 18. Where panels are installed, they are positioned adjacent one another and can be interlocked with cooperating tongue and groove or similar features. The rigid sheet, or panels thereof, is positioned to create a structural bridge over upper hollows 28.

At 110, the method comprises securing the rigid sheet 54, or panels thereof, by threaded fasteners 56 to upper rib portions 24 of the corrugated sheet 50. Fasteners 56 preferably have enlarged heads 60 on the end thereof which engage the rigid sheet 54. Fastener holes formed in the rigid sheet 54 are preferably countersunk to receive the enlarged heads 60, resulting in a uniform upper surface.

Threaded fasteners 56 are installed from above the rigid sheet 54 extending downwardly through the rigid sheet and through the upper rib portions 24. Securing the rigid sheet 54 can further include securing a plurality of panels thereof adjacent to one another to cover the corrugated deck 50 or panels thereof. Spaced apart threaded fasteners 56 are secured from above the rigid sheet, through the rigid sheet and through the upper rib portions 24 of the deck 50. The method can include securing the rigid sheet, or panels thereof, to create a structural bridge over upper hollows 28.

Figure 4:
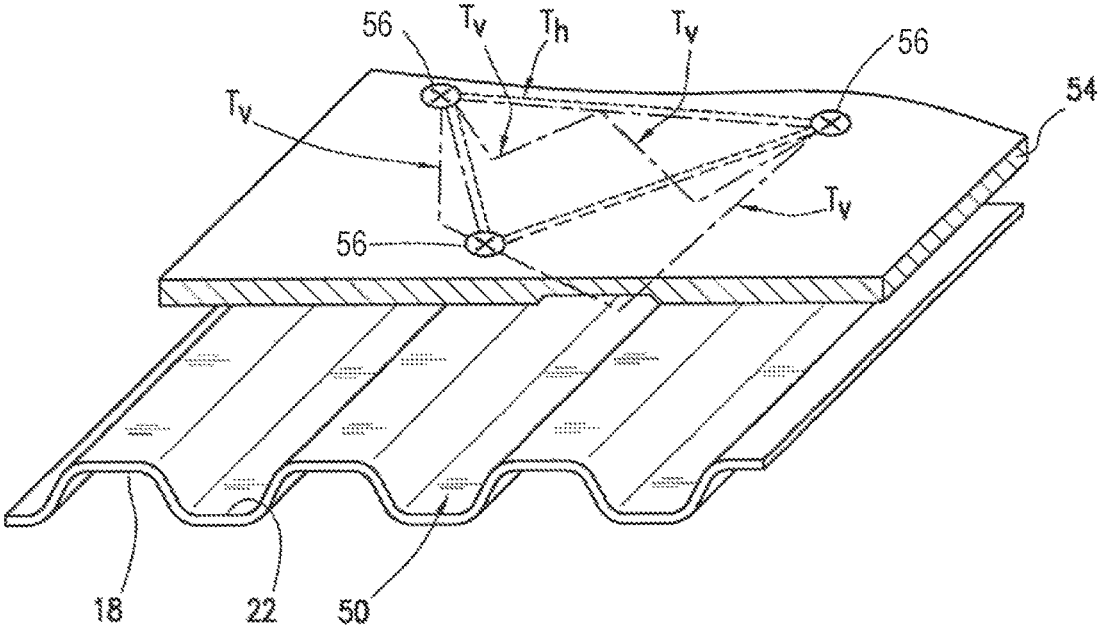
FIG. 4 is a cross-sectional, orthogonal, partial view of two corrugated deck panels positioned adjacent one another according to an aspect of the disclosure.

The method includes, at 110, securing the fasteners 56, oriented in a selected pattern, and forming a series of generally triangular-shaped, horizontally-disposed, trusses $T_h$ and a series of vertically-disposed trusses $T_v$ throughout the length and width of deck spans between spaced horizontal supports 14 to increase resistance to horizontal and vertical planar deflection of the roof deck as seen in FIG. 4. The method includes providing flexural strength and diaphragm stiffness to the roof deck by securing the rigid sheet to the upper rib portions of the deck and restraining relative horizontal movement of the deck ribs using the rigid sheet and fasteners. The method includes forming a horizontal, triangular-shaped truss $T_h$ in the horizontal plane of the rigid sheet, having a triangular segment of the rigid sheet 54 restrained by adjacent mechanical fasteners 56 to upper ribs 24 of corrugated sheet 50 in a span between horizontal supports 14.

The upper deck ribs are in compression when a downwardly directed force is applied above the deck. The fasteners 56 are positioned such that buckling of the unsupported length of the upper rib portions is minimized. The rigid sheet 54, or panels thereof, are relatively high density, relatively planar, fire and water resistant board selected to provide resistance to high impacts and concentrated loads without rupturing, and to contribute to the composite roof load capacity. The rigid sheet 54 may comprise a plurality of panels, which may have cooperating tongues and grooves formed thereon to provide continuous interlocking of panels. The method may include interlocking adjacent rigid sheet panels, and more specifically, interlocking adjacent panels using cooperating tongue and groove features 62.

Fasteners 56 are secured through the rigid sheet and upper rib portions 24 and oriented in a pattern to form a vertical truss $T_v$ comprising: a section of the rigid sheet spanning upper hollow 28 between adjacent upper ribs and between adjacent fasteners 56, the adjacent fasteners 56, and connector portions 26 of the corrugated deck between the ribs.

The method can include determining a functional fastener pattern for use in securing the rigid sheet to the corrugated deck, calculating necessary spacing between fasteners, using deck span measurements in such calculations, using length, width, and height measurements of the deck in such calculations, using roof shape in such calculations, and using horizontal support spacing measurements in such calculations.

The method can include, at 110, spacing the trusses $T_v$ and $T_h$ from the horizontal supports 14 and preventing lateral and vertical distortion of the corrugated deck 50 as a result of force applied in the plane of the rigid sheet 54. The method can further include maintaining the joint stability of adjacent rigid sheet panels using a selected fastener pattern or installed fasteners in such a pattern.

The composite roof deck functions as a structural diaphragm, providing rigidity. Fasteners 56, oriented in a pattern at horizontally spaced locations transversely of the span, and at spaced locations longitudinally of the span, form a series of essentially triangular shaped trusses $T_h$ and $T_v$ in the horizontal and vertical planes throughout and across the span, between the horizontal supports, and stabilize and prevent lateral and vertical deformation of the individual ribs of the corrugated deck, increasing resistance to horizontal and vertical planar deflection of the deck.

The methods herein disclosed are typically required to be completed in a single day's work since the building is usually occupied or operational and must be kept in the dry.

The methods herein disclosed may further include, at 114, application of a roof covering 78 to the upper surface of the rigid sheet or panels thereof. The roof covering is preferably a smooth, flat, single-ply synthetic material. Typical coverings are made of EPDM, TPO, or PVC, for example. The covering is preferably adhered to the rigid sheet. For example, a layer of asphalt can be applied to the upper surface of the roof and a covering of modified bitumen laid atop the asphalt or other adhesive. Alternately, some roof coverings can be applied to the upper surface of the roof and then heated in place to self-adhere to the below roof component.

Figure 5:
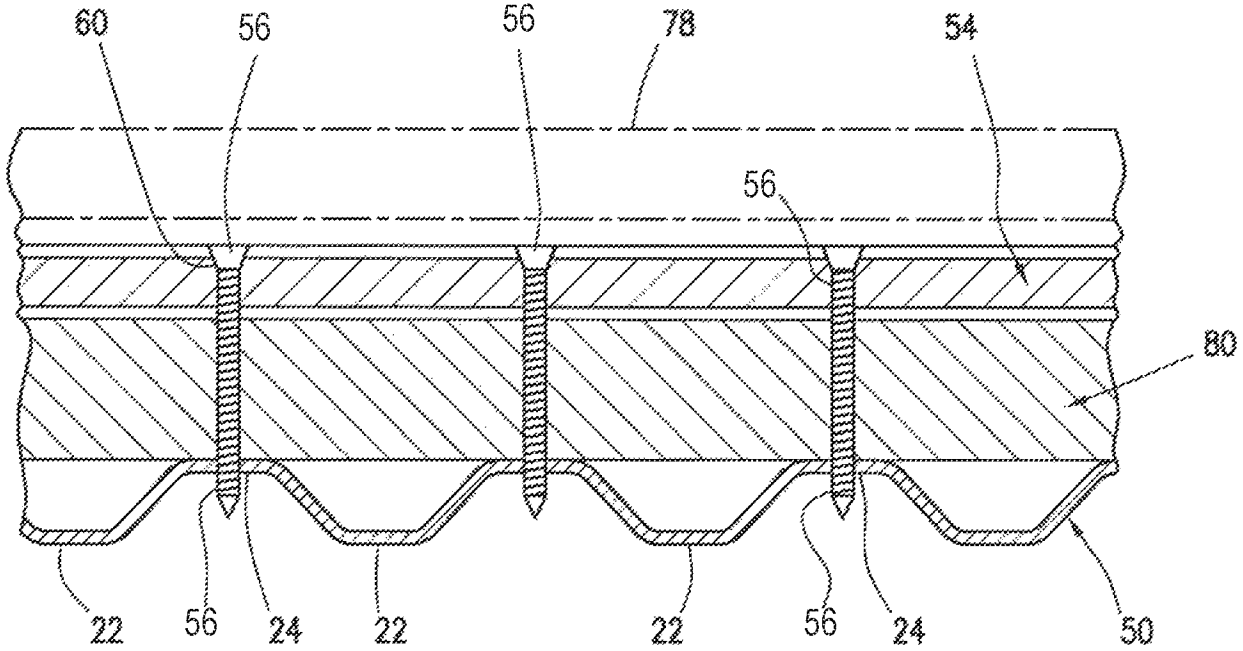
FIG. 5 is a cross-sectional elevational illustration of an alternate exemplary dry-installed, composite strength roof deck assembly installed according to aspects of the disclosure. Numeral references are employed to designate like parts throughout the various figures of the drawing.

The methods herein may further include, at 112, application of insulation material 80. The insulation material can be positioned in a sandwiched position between the corrugated deck 50 and the rigid sheet 54, as seen in FIG. 5, or in a position above the rigid sheet 54, as seen in FIG. 3. Where an insulation layer is applied, the above-described methods are modified accordingly such that securing of roofing components includes extending fasteners through the insulation layer. For further disclosure in this regard see the incorporated references.

The methods disclosed herein may further include, at 116, installation of ventilating apparatus to control temperature and air pressure below the roof deck. Provision of ventilation apparatus to relieve pressure includes communicating air flow such that change in air pressure above the rigid sheet is accompanied by simultaneous change in air pressure in lower hollows below the rigid sheet. This minimizes the likelihood that sufficient pressure differential will exist to separate rigid sheets 54 from the stronger corrugated deck 50. For further disclosure in this regard see the incorporated references.

The methods disclosed herein may further include, at 116, installation of a heat exchanger or the like to eliminate condensation on the corrugated deck and form a vapor barrier between the interior of the building and the roofing. For further disclosure in this regard see the incorporated references.

From the foregoing it should be readily apparent that while the symmetrically corrugated deck, rigid sheet, and optional insulation layer are insufficient in strength characteristics to form a roof assembly when separately considered, the components installed and considered working together or in composite have superior strength. In view of the unorthodox characteristics and functions of the individual components when assembled in a dry-installed composite roof, mathematical calculation of composite strength is infeasible. However, strength characteristics and comparisons with existing structures have been observed by actual construction and testing. Empirical data has been analyzed and formulated into a predictable pattern by applying engineering principles.

The invention is defined by the claims appended hereto and the specification is not limiting to the claim interpretation. It is understood that other and further embodiments of the disclosed methods can be devised without departing from the basic concepts explained herein. Terms take their normal and ordinary meanings unless otherwise addressed herein. The various steps, actions, procedures, etc., described herein are limited in their respective order only when so indicated by the claims. Further, such actions can be omitted, repeated, changed in order, etc., as a person of skill in the art will recognize. Application of common sense by someone of skill in the art should educate use of the disclosed methods and any modifications thereof.

We claim:

1. A method of retrofitting a substantially horizontal, composite strength concrete roof assembly comprising concrete over a corrugated steel deck, the corrugated deck defining a plurality of alternating upper and lower ribs, to form a substantially horizontal, dry-installed composite strength roof assembly, the method comprising:

a) removing concrete from the corrugated deck of the composite strength concrete roof assembly, the corrugated deck having a length and a width;

b) exposing the upper rib portions of the corrugated deck of the composite strength concrete roof assembly;

c) exposing at least selected locations of the upper surfaces of the lower rib portions of the corrugated deck of the composite strength concrete roof assembly to permit fastening of the corrugated deck to an underlying horizontal support;

d) mechanically fastening the corrugated deck of the composite strength concrete roof assembly to the underlying horizontal support at exposed locations of the lower rib portions;

e) positioning a rigid sheet horizontally over the corrugated deck of the composite strength concrete roof assembly and spanning adjacent upper ribs of the corrugated deck; and f) mechanically fastening the rigid sheet to the upper rib portions of the corrugated deck of the composite strength concrete roof assembly using mechanical fasteners oriented to form a series of generally triangular-shaped, horizontally-disposed trusses and a series of vertically-disposed trusses the length and width of the corrugated deck.

2. The method of claim 1, wherein c) further comprises completely exposing the upper surfaces of the lower rib portions of the corrugated deck of the composite strength concrete deck.

3. The method of claim 1, wherein f) further comprises fastening at least one mechanical fastener through the rigid sheet and into each upper rib of the corrugated deck.

4. The method of claim 1, wherein the corrugated deck is comprised of a plurality of corrugated panels positioned adjacent one another and defining seams therebetween, and further comprising removing concrete from the seams between adjacent panels, and further comprising mechanically fastening adjacent panels together proximate the seams.

5. The method of claim 4, wherein the seams are fastened together by threaded mechanical fasteners.

6. The method of claim 4, further comprising fastening the panels of corrugated deck together to create a monolithic deck wherein the panels of corrugated deck are restrained from relative movement.

7. The method of claim 1, further comprising removing ventilation members positioned at the corrugated deck.

8. A method of retrofitting a substantially horizontal, pre-existing, composite strength concrete roof assembly comprising concrete over a corrugated steel deck spanning between spaced horizontal supports, the corrugated deck defining a plurality of alternating upper and lower ribs, to form a substantially horizontal, dry-installed composite strength roof assembly comprising a rigid sheet mechanically fastened to a replacement corrugated steel deck spanning between the spaced horizontal supports, the method comprising:

a) removing the concrete from the pre-existing corrugated deck;

b) exposing upper surfaces of the upper ribs of the pre-existing corrugated deck;

c) positioning a rigid sheet horizontally over the pre-existing corrugated deck and creating spans across adjacent upper ribs of the pre-existing corrugated deck; and d) mechanically fastening the rigid sheet to the upper ribs of the pre-existing corrugated deck, the mechanical fasteners arranged across the rigid sheet and the upper ribs of the pre-existing corrugated deck;

e) mechanically restraining, using the arranged fasteners, relative movement between the upper ribs of the pre-existing corrugated deck and the rigid sheet, and preventing independent horizontal and vertical movement of the upper ribs of the pre-existing corrugated deck which would tend to distort under a downward load applied to the rigid sheet and to restrain buckling of the upper ribs; and f) creating a dry-installed roof deck assembly spanning between horizontal supports and having a composite strength greater than the sum of the strength of separate similar spans of corrugated deck alone and of the rigid sheet alone which are not mechanically fastened together.

9. The method of claim 8, wherein c) further comprises exposing upper surfaces of the lower ribs of the pre-existing corrugated deck.

10. The method of claim 8, wherein f) further comprises fastening mechanical fasteners through the rigid sheet and into each upper rib of the pre-existing corrugated deck.

11. The method of claim 8, wherein the pre-existing corrugated deck is comprised of a plurality of corrugated deck panels positioned adjacent one another and defining seams therebetween, and further comprising removing concrete from the seams, and further comprising mechanically fastening adjacent corrugated deck panels together proximate the seams.

12. The method of claim 11, wherein the seams are fastened together by threaded mechanical fasteners.

13. The method of claim 11, further comprising fastening the corrugated deck panels together to create a monolithic, corrugated deck, wherein the corrugated deck panels are restrained from movement relative to one another.

14. A method of retrofitting a substantially horizontal, pre-existing, composite strength concrete roof assembly comprising concrete over a corrugated steel deck spanning between and supported from below by spaced horizontal supports, the corrugated deck defining a plurality of alternating upper and lower ribs, to form a substantially horizontal, dry-installed composite strength roof assembly, the method comprising:

a) removing concrete from the pre-existing corrugated deck;

b) removing at least a damaged portion of the pre-existing corrugated deck;

c) replacing the removed, damaged portion of the pre-existing corrugated deck with replacement corrugated steel deck, the replacement corrugated steel deck defining a plurality of alternating upper and lower ribs;

d) attaching the replacement deck to span between the horizontal supports;

e) positioning a plurality of rigid sheet panels horizontally over the replacement corrugated deck, creating rigid sheet spans across adjacent upper ribs of the replacement corrugated deck;

f) mechanically fastening the rigid sheet panels to the upper ribs of the replacement corrugated deck, the fasteners arranged across the rigid sheet panels and the upper ribs of the replacement corrugated deck, each of the fasteners extending through a said rigid sheet panel and through the replacement corrugated deck;

g) arranging the fasteners to form a series of vertically-disposed trusses positioned in the span, each such truss comprising a section of rigid sheet panel spanning between adjacent upper ribs of the replacement corrugated deck, mechanical fasteners extending through the rigid sheet panel and into the adjacent upper ribs, and the replacement corrugated deck extending transversely between the adjacent upper ribs in a generally vertical plane; and h) arranging the fasteners to form a series of horizontally-disposed, triangular-shaped trusses positioned in the span, each truss comprising a section of rigid sheet panel spanning adjacent upper ribs of the replacement corrugated deck and restrained by adjacent fasteners to the upper ribs of the replacement corrugated deck.

15. The method of claim 14, further comprising attaching the replacement deck to span between the horizontal supports by extending mechanical fasteners through the lower ribs of the replacement corrugated sheet and into the horizontal supports.

16. The method of claim 14, wherein the replacement corrugated deck defines a symmetrical rib pattern above and below a neutral axis of the replacement corrugated deck.

* * * * *